US010525465B2

(12) United States Patent
Prins et al.

(10) Patent No.: US 10,525,465 B2
(45) Date of Patent: Jan. 7, 2020

(54) CARTRIDGE FOR UPTAKE AND PROCESSING OF A SAMPLE

(71) Applicant: KONINKLIJKE PHILIPS N.V., Eindhoven (NL)

(72) Inventors: Menno Willem Jose Prins, Rosmalen (NL); Godefridus Johannes Verhoeckx, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 428 days.

(21) Appl. No.: 14/646,826

(22) PCT Filed: Nov. 26, 2013

(86) PCT No.: PCT/IB2013/060399
§ 371 (c)(1),
(2) Date: May 22, 2015

(87) PCT Pub. No.: WO2014/083496
PCT Pub. Date: Jun. 5, 2014

(65) Prior Publication Data

US 2015/0314288 A1 Nov. 5, 2015

Related U.S. Application Data

(60) Provisional application No. 61/731,143, filed on Nov. 29, 2012.

(51) Int. Cl.
*B01L 3/00* (2006.01)

(52) U.S. Cl.
CPC ... *B01L 3/502715* (2013.01); *B01L 2200/027* (2013.01); *B01L 2200/10* (2013.01); *B01L 2300/16* (2013.01); *B01L 2400/0694* (2013.01)

(58) Field of Classification Search
CPC ..... B01L 3/5027; B01L 3/50273; B01L 2300/044; B01L 2300/0819; B01L 2300/0861; B01L 2400/0487; B01L 2400/049
USPC ..... 422/502, 503
See application file for complete search history.

(56) References Cited

U.S. PATENT DOCUMENTS

2004/0241042 A1* 12/2004 Pugia ..... B01L 3/502707 422/421
2005/0130292 A1* 6/2005 Ahn ..... A61B 5/14532 435/287.1
2005/0152807 A1 7/2005 Osterloh et al.
2009/0053732 A1 2/2009 Vermesh et al.
(Continued)

FOREIGN PATENT DOCUMENTS

DE 202004005636 U1 6/2004
EP 1403383 A1 3/2004
(Continued)

*Primary Examiner* — Jill A Warden
*Assistant Examiner* — Dwayne K Handy

(57) ABSTRACT

A cartridge includes an inlet portion that is connected to an assay chamber and a suction reservoir. The inlet portion is configured to allow a direct uptake of sample medium. During this uptake, air is trapped in the assay chamber, which prevents a premature entrance of the sample medium into the assay chamber. The transfer of the sample medium from the inlet portion to the assay chamber is thus controllably initiated at a later time, for example by opening a vent port connected to the assay chamber.

15 Claims, 2 Drawing Sheets

(56) References Cited

U.S. PATENT DOCUMENTS

| | | | |
|---|---|---|---|
| 2009/0291507 | A1 | 11/2009 | Clemmens et al. |
| 2009/0314366 | A1 | 12/2009 | Weng et al. |
| 2010/0112723 | A1 | 5/2010 | Battrell et al. |
| 2012/0115738 | A1 | 5/2012 | Zhou et al. |

FOREIGN PATENT DOCUMENTS

| | | | |
|---|---|---|---|
| EP | 2047910 | B1 | 1/2012 |
| EP | 1419818 | A1 | 11/2013 |
| WO | 2010070521 | A1 | 6/2010 |
| WO | 2011133540 | A2 | 10/2011 |

* cited by examiner

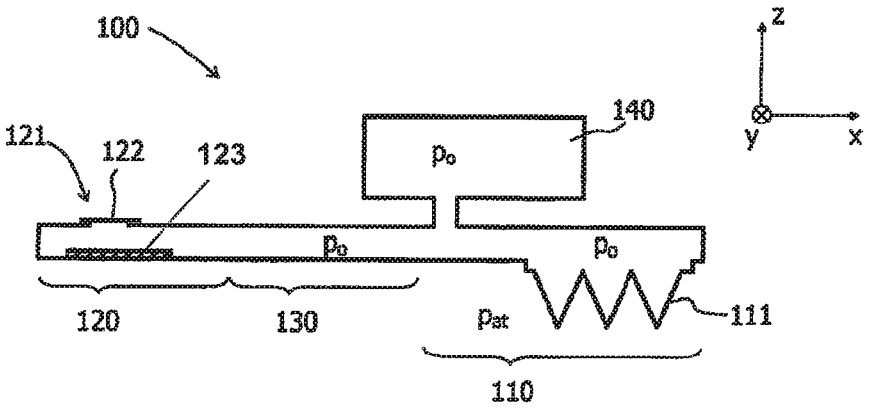
Fig. 1
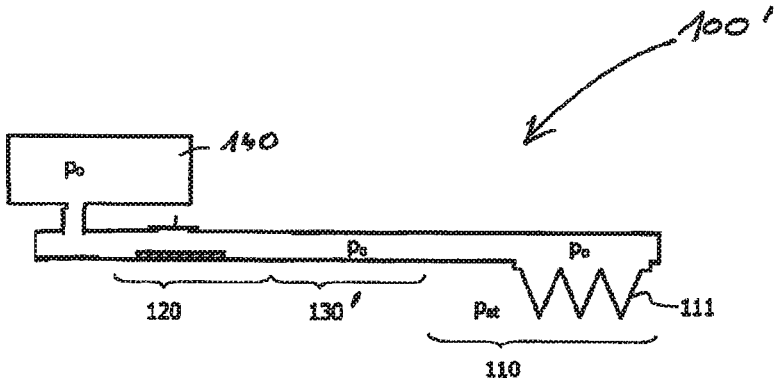
Fig. 1bis

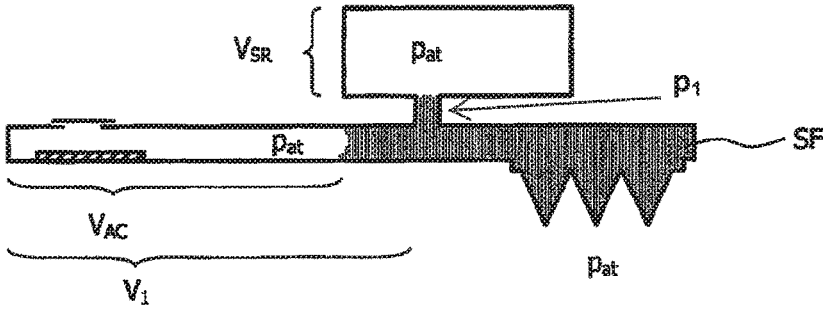
Fig. 2
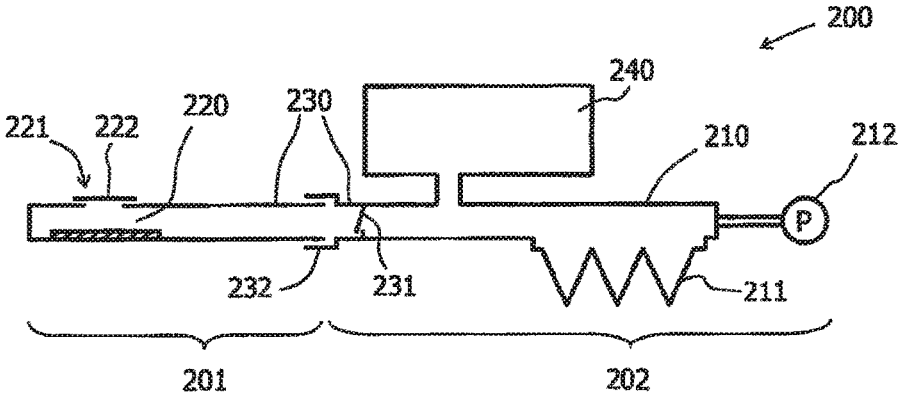
Fig. 3
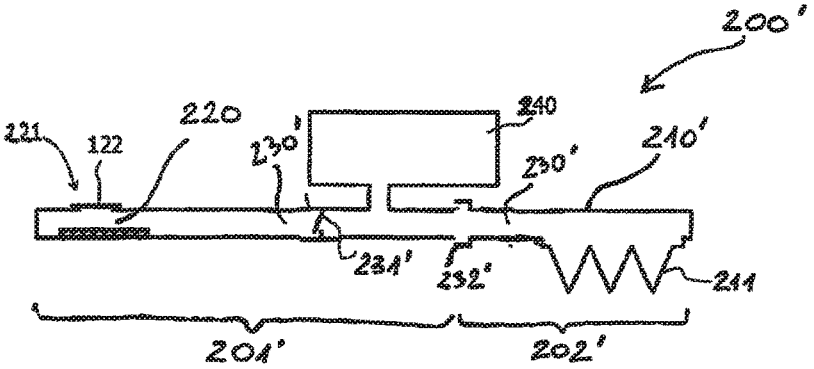
Fig. 3bis

CARTRIDGE FOR UPTAKE AND PROCESSING OF A SAMPLE

CROSS-REFERENCE TO PRIOR APPLICATIONS

This application is the U.S. National Phase application under 35 U.S.C. § 371 of International Application No. PCT/IB2013/060399, filed on Nov. 26, 2013, which claims the benefit of U.S. Provisional Patent Application No. 61/731,143, filed on Nov. 29, 2012. These applications are hereby incorporated by reference herein.

FIELD OF THE INVENTION

The invention relates to a cartridge and to a method for the uptake and processing of a medium in a cartridge.

BACKGROUND OF THE INVENTION

The WO 2010/070521 A1 discloses a sensing device in which a sample is transported from an inlet port along a channel until it reaches a flow stop. The sample may then be passed on to a measurement chamber by changing the pressure on one or both sides of the flow stop.

SUMMARY OF THE INVENTION

It would be desirable to have means that allow for a more robust and/or user-friendly handling of a sample in a cartridge.

A first embodiment of the invention relates to a cartridge for the uptake and processing of a medium, for example of a biological sample fluid like blood, saliva or urine. The cartridge is typically an exchangeable element or unit with which a sample medium can be provided to an apparatus for processing. It will usually be a disposable component which is used only once for a single sample. The cartridge comprises the following components:

a) An inlet portion with (at least) one inlet via which medium to be processed can be taken up.

b) A chamber in which said medium can be processed. For this reason, this chamber will in the following be called "assay chamber".

c) A further chamber that will be called "suction reservoir" in the following.

Furthermore, the mentioned assay chamber and the suction reservoir shall be connected to the inlet portion in such a way that a quantity of air is trapped in the assay chamber when the medium fills the inlet portion.

It should be noted that the word "air" is to be understood as a generic term for any gas that initially fills the assay chamber (and usually also the suction reservoir and the inlet portion). Besides air in the narrower sense of the word, this may for instance be an inert gas.

Typically, a second quantity of air is trapped in the suction reservoir when the medium fills the inlet portion. Trapping of air in the assay chamber and/or the suction reservoir usually requires that said chamber and said reservoir are, at this stage, connected to the environment only via the inlet portion (otherwise, the air could escape through the other connection).

The cartridge has the advantage that its inlet portion can first be filled with the medium to be processed, wherein the trapped air in the assay chamber guarantees that this medium does not immediately advance to the assay chamber. The transfer of the medium into the assay chamber can therefore later be done in a precisely controlled manner, which is favorable for many processing procedures, particularly for accurate measurements. The suction reservoir turns out to be advantageous in this process because it allows for a better reproducible and a more robust uptake of the medium up to a point where it does not enter the assay chamber.

The assay chamber and the inlet portion are preferably connected by a capillary channel, i.e. a channel with features that allow for the advancement of the medium by capillary forces in the second stage of the operation. For an aqueous medium, a capillary channel will for example typically have a hydrophilic surface and an internal size of less than about 1 mm, preferably less than about 0.1 mm (wherein said size is, for a channel of arbitrary geometry, defined as the diameter of the largest sphere that completely fits into the channel). Providing a capillary channel has the advantage that the medium to be processed will "automatically" be transported from the inlet portion to the assay chamber, provided that this transport is not stopped by a counter pressure (as it shall be the case after the initial filling of the inlet portion).

The assay chamber may preferably be connected to or comprise an outlet, which will be called "vent port" in the following and which is closed during the filling of the inlet portion with the medium to be processed. As its name implies, the vent port allows, after its opening, for the escape of the air trapped in the assay chamber. Opening of the vent port therefore particularly allows for a further transportation of the medium taken up in the inlet portion into the assay chamber.

The vent port may for example be closed by a controllable valve. As the vent port often needs to be opened only once (for starting an assay in a disposable cartridge), it may also be realized by an initially closed foil or membrane, wherein said foil or membrane is punctured and disrupted in order to start the filling of the assay chamber.

In another embodiment of the cartridge, the assay chamber, the inlet portion, and/or the suction reservoir is connected to a pressure actuator for controlling its pressure (or, more precisely, the pressure of the air or other medium filling the assay chamber or the inlet portion, respectively). A pressure actuator connected to the assay chamber can for example be used to generate an underpressure in said chamber after the initial filling of the inlet portion, thus inducing the ingress of medium into the assay chamber. The same result can be achieved with a pressure actuator connected to the inlet portion that generates an overpressure.

According to another embodiment, a flow stop may be disposed in the connection between the inlet portion and the assay chamber. Such a flow stop allows for an improved control of the transfer of medium from the inlet portion to the assay chamber, thus further increasing the robustness of the usage of the cartridge.

The aforementioned flow stop may for example comprise a valve that can externally be controlled. Additionally or alternatively, it may comprise a pressure-controlled valve, i.e. a valve which opens and closes if a particular pressure and/or pressure difference is present on one or both sides. The advantage of such a pressure-controlled valve is that it requires no external control but works automatically depending on the pressure in the inlet portion and the assay chamber, respectively.

The pressure-controlled valve may particularly be a diode valve or one-way valve, i.e. a valve that opens only if the pressure on a first side is higher (by a given difference) than the pressure on a second side, thus allowing a flow only in one direction from the first to the second side.

In still another embodiment, the flow stop between the inlet portion and the assay chamber may comprise a medium-repelling surface coating. If an aqueous medium shall be processed, the medium-repelling surface coating may for example be hydrophobic. Such a kind of flow stop is particularly useful in a capillary connection between the inlet portion and the assay chamber.

The inlet portion may preferably comprise a sample extraction element, for example a needle or a needle array for extracting a sample from a biological organism. One single cartridge then allows for both the extraction, uptake, and processing of a sample medium.

The inlet portion may optionally be closed before use of the cartridge, i.e. before the uptake of a medium. Such a closure prevents a contamination of the sensitive interior components of the cartridge.

According to a further development of the aforementioned embodiment, an underpressure (relative to the ambient atmospheric pressure) may be provided in the inlet portion, the assay chamber, and/or the suction reservoir before the uptake of a medium into the inlet portion. Such an underpressure can for example be generated during the manufacturing of the cartridge and be preserved with the help of the aforementioned closure of the inlet portion with respect to the environment. The underpressure can be used to automatically suck a medium into the inlet portion once this medium can enter the inlet portion and is exposed to the underpressure.

In order to minimize the amount of medium that enters the suction reservoir (and that is hence usually lost for other processing purposes), a flow stop may optionally be disposed in the suction reservoir, particularly close to its inlet.

The cartridge with the assay chamber and the inlet portion may be a one-piece component. According to another embodiment, the assay chamber and the inlet portion may be disposed in (two) different parts that can be coupled to each other to constitute the whole cartridge. In this case the inlet portion can optionally be used independently of the assay chamber.

The invention further relates to a method for the uptake and processing of a medium in a cartridge with an inlet portion, an assay chamber, and a suction reservoir, wherein the assay chamber and the suction reservoir are connected to the inlet portion. The method comprises the following steps:

a) Uptake of medium into the inlet portion of the cartridge until this uptake is stopped by the counter-pressure built-up in air that is trapped in the assay chamber and in the suction reservoir.

b) Transporting the aforementioned medium into the assay chamber.

The method can particularly be executed with a cartridge of the kind described above. The method and the cartridge are different realizations of the same inventive concept, i.e. the uptake of a medium until it is stopped by a counter-pressure in an assay chamber and a suction reservoir. Explanations and definitions provided for one of these realizations are therefore valid for the other realization, too.

The transportation of the medium into the assay chamber (step b) can particularly be achieved by a change of the pressure in the assay chamber and/or in the inlet portion. Additionally or alternatively, a vent port connected to the assay chamber can be opened, thus allowing for the escape of air from the assay chamber.

The invention further relates to the use of a cartridge of the kind described above for molecular diagnostics, biological sample analysis, chemical sample analysis, food analysis, and/or forensic analysis. Molecular diagnostics may for example be accomplished with the help of magnetic beads or fluorescent particles that are directly or indirectly attached to target molecules.

BRIEF DESCRIPTION OF THE DRAWINGS

These and other aspects of the invention will be apparent from and elucidated with reference to the embodiments described hereinafter.

In the drawings:

FIG. 1 schematically shows a side view of a cartridge with an assay chamber and an inlet portion according to a first embodiment of the invention;

FIG. 1*bis* schematically shows a side view of a cartridge with an assay chamber and an inlet portion according to a further embodiment of the invention;

FIG. 2 shows the cartridge of FIG. 1 after the uptake of a sample medium;

FIG. 3 shows a modification of the cartridge of FIG. 1 in which assay chamber and inlet portion are accommodated in different parts with a diode valve between them; and FIG. 3*bis* shows a modification of the cartridge of FIG. 3 in which assay chamber and inlet portion are accommodated in different parts with a diode valve between them.

Like reference numbers or numbers differing by integer multiples of 100 refer in the Figures to identical or similar components.

DETAILED DESCRIPTION OF EMBODIMENTS

Simple and high-quality sample taking is important for rapid biosensing applications, in order to guarantee a reliable result even in circumstances with little control, e.g. outside a laboratory and with non-professional users. Preferably a reliable measurement is done on only a small sample volume, and the sample taking should not generate pain. Methods to get a small fluid sample comprise for example a pin prick, a needle, a capillary etc.

For biosensing applications, it is important to view the sample taking in combination with the subsequent processing, i.e. the cartridge and reader technology (assuming that the sample is handled in a cartridge). An example of a technology for rapid biosensing is the Magnotech® technology developed by the applicant. The cartridges that will be described in the following may (inter alia) be used with this biosensing technology.

A cartridge 100 according to a first embodiment of the invention is schematically shown in a sectional side view in FIGS. 1 and 2. The cartridge 100 comprises an inlet portion 110 that is designed to allow for the uptake of a sample medium, for example of blood from a patient. To this end, the inlet portion 110 is provided with an appropriate sample entry port 111, for example a foil, a skin adhesive, needles or spikes that can pierce into a biological object for the extraction of blood or other body fluids.

The inlet portion 110 is connected via a channel 130 to an assay chamber 120. The assay chamber 120 may for example be provided with capture sites (e.g. antibodies) on its surface for the execution of detection assays with the sample medium (cf. WO 2010/070521 A1). The total volume of the channel 130 and the assay chamber 120 is denoted as $V_1$. The assay chamber 120 additionally comprises a vent port 121, which is in the initial state of the cartridge 100 (FIGS. 1, 2) closed by some pierceable membrane or foil 122.

The cartridge 100 further comprises a suction reservoir 140 which has a volume $V_{SR}$ and which is connected to the inlet portion 110.

FIG. 2 shows the same cartridge 100 after the inlet portion 110 has been filled by a sample medium SF This filling can be achieved "automatically" if the interior of the cartridge 100 (i.e. the inlet portion 110, the assay chamber 120, and the suction reservoir 140) is filled with a gas (simply denoted as "air" in the following) having an underpressure $p_0$ (i.e. $p_0<p_{at}$ with $p_{at}$ being the ambient pressure; in absolute values, this may be achieved if $p_0<950$ hPa). Upon activation of sample taking (e.g. when the needles 111 pierce into a biological object), the sample fluid SF moves into the inlet portion 110. The needles are closed initially and are opened when activated. Upon filling of the inlet portion with sample fluid, the air is being displaced toward the assay chamber 120 and suction reservoir 140. The entrapped gas is being compressed and a pressure builds up in the assay chamber 120 and suction reservoir 140. After a certain total amount of fluid transport, the gas compression will be high enough and thereby hinder the further filling of the inlet portion 110. Therefore, the filling of the inlet portion 110 by sample fluid SF can be controlled by having a gas entrapped in the cartridge 100.

If a further filling is desired (e.g. to enable complete wetting and the start of the biosensing assay in the assay chamber 120), the compressed air needs to be released. This can be done by the release of a mechanical obstruction or by the application of a suction (not shown). A preferred embodiment is that the foil 122 of the vent port 121 is pierced at the end of the assay chamber 120 so that the filling process can proceed, e.g. driven by capillary forces.

The following volumes can be identified within the cartridge 100:

- $V_1$, the total volume of the assay chamber 120 and the channel 130 (starting at the branch to the suction reservoir 140);
- $V_{AC}$, the volume of the assay chamber that has a time-critical process.

The assay chamber may for example contain antibody-coated nanoparticles 123 and the timing of the incubation process may be critical. The incubation process inside VAC should therefore not be influenced by the sample taking process. Moreover, the critical assay should be independent of potential disturbances from the outside, such as user movement, pressure shocks, duration of sample taking, separation of the cartridge 100 from the biological object, etc.

As explained above, the pressure in the cartridge 100 equals $p_0$ upon activation of sample taking. The gas pressure in the cartridge increases when sample fluid SF is entering, because the fluid displaces and compresses the gas. When the sample fluid reaches the opening of the suction reservoir 140, the pressure is defined as $p_1$. Thereafter, the sample fluid SF will enter the suction reservoir 140 as well as the assay chamber 120 until a sufficient counter-pressure has built up. When the cartridge is released from the biological object, the sample fluid and the gas in the cartridge 100 attain the ambient pressure $p_{at}$.

Due to parasitic gas pockets or gas leaks in the cartridge, or due to gas that is dissolved in the medium and is released during the filling process, the uptake of sample fluid SF may vary. In order to improve the gas tolerance of the filling process, the suction reservoir 140 of volume $V_{SR}$ has been added. The pressure $p_1$ (attained when the sample fluid reaches the opening of the suction reservoir 140) should be low enough to reliably pull sample fluid SF into the inlet portion; but the pressure $p_1$ should not be too low, otherwise the assay chamber $V_{AC}$ may be wetted prematurely.

We can make a rough estimate of the lower bound of $p_1$ under the simplified assumption that the total mass of gas entrapped in portion $V_1$ (i.e. assay chamber 120 and the channel 130) is constant from the moment that the sample fluid has reached the opening of the suction reservoir 140. Using the ideal gas law, we find following equation:

$$p_{at} \cdot V_{AC} \leq p_1 \cdot V_1$$

Under the simplified assumptions, the equation illustrates that $p_1$ should not be too low, otherwise the assay chamber $V_{AC}$ may already become wetted when the gas pressure reaches the atmospheric pressure. Considering the fact that $p_1$ is determined by the initial pressure $p_0$ in the cartridge and the total volume of inlet portion, assay chamber, and suction reservoir, the equation comprises a boundary condition for the design of the cartridge and the initial pressure $p_0$.

An advantage of the cartridge 100 is that the cartridge pressure $p_1$ is well-defined due to the additional suction reservoir 140.

In order to limit loss of sample fluid SF into the suction reservoir 140, a capillary stop can optionally be added to the suction reservoir 140 (e.g. realized by a hydrophobic coating of the inlet of suction reservoir 140).

The non-wetting of the assay chamber volume $V_{AC}$ causes a time delay of the assay in the cartridge. The assay will only start when a trigger is given so that $V_{AC}$ is wetted. The wetting of $V_{AC}$ can be activated by opening a vent through that the gas can move out. For example, a mechanical obstruction can be removed, a vent seal can be pierced (by the reader device or by an action of the user), a mechanical notch can be released, a foil can be peeled off, etc.

In an alternative embodiment depicted by FIG. 1*bis*, the suction reservoir 140 is located downstream the assay chamber 120, i.e. the assay chamber 120 is located between the suction reservoir 140 and the inlet portion 110.

In the same way as in the embodiment of FIG. 1, the equilibrium between the fluid sample SF is found when the gas included in the cartridge 100' is in a volume equal to ($V_{SR}+V_{AC}$)—the only difference is that $V_{SR}$ is, in this alternative embodiment, located downstream the $V_{AC}$, and not upstream like in FIG. 1. Actual volumes and dimensions may be slightly different for the two cases in order to get a suitable stopping position of the liquid.

The cartridges 100 and 100' of FIGS. 1, 1*bis* and 2 are an example of a "fully integrated cartridge" in the sense that a Sample Taking Unit ("STU"), here realized by the inlet portion 110, and a Detection Assay Unit ("DAU"), here realized by the assay chamber 120, are integrated in one single piece.

One method to use such a cartridge is that the user puts a sample into the cartridge while it is outside the associated reader apparatus, and then puts the loaded integrated cartridge into said reader. Advantages of this approach are that the user can take the sample without the reader, a freedom to choose the sampling area on the body, a freedom of the patient to move, a freedom of the sampling location being away from the reader location, possibly less stress for the patient (cartridge approaches the patient, the patient is not pulled toward the reader).

Another method to use such a cartridge is that the user puts a sample into the cartridge while the cartridge is inside the reader. Advantages of this approach are that the reader controls and monitors the sampling process and that the cartridge can be fed from a stock in the reader (e.g. a carrousel).

FIG. 3 shows a cartridge 200 which is a modification of the cartridge 100 of FIGS. 1 and 2. The components that are similar or identical to those of the first cartridge 100 are denoted with the same reference numbers increased by 100. In the following, only the differences with the described in more detail.

A first difference is that the cartridge 200 consists of two parts 201 and 202. The first part 201 contains the assay chamber 220 and a section of the channel 230, while the second part 202 contains the inlet portion 210, the suction reservoir 240, and the remainder of the channel 230. The first part 201 and the second part 202 can be coupled with for example a plug-and-socket type connection unit 232 in the middle of the channel 230.

The cartridge 200 of FIG. 3 is an example of a cartridge with separate Sample Taking Unit ("STU") and Detection Assay Unit ("DAU").

One method to use such a cartridge is that the user takes a sample into the STU, inserts the DAU into the reader, and clicks the filled STU onto the DAU when it is in the reader. An advantage of this approach is that the DAU can be fed from a stock in the reader (e.g. a carrousel).

Another method to use such a cartridge is that the user takes the sample into the STU, clicks the filled STU onto the DAU before it is in the reader, and thereafter clicks STU with the DAU into the reader.

A second modification of the cartridge 200 comprises a flow stop in the channel 230, for example realized as a diode or one-way valve 231. A diode valve is a valve that is closed for flow in one direction (underpressure) and open for flow in another direction (overpressure). When the inlet portion 210 is being filled by an underpressure that is applied to the inlet portion 210, the diode valve 231 is closed because the assay chamber 220 is at a higher pressure. When the filling of inlet portion 210 is accomplished, a pressure is applied to the inlet portion 210 (e.g. by a mechanical force or by the shown pressure generator 212); this generates an overpressure in the inlet portion 210 with respect to the assay chamber 220, and thus drives the sample fluid SF through the channel 230 into the assay chamber 220. It is preferred that the biological object from which the sample fluid is taken (e.g. a finger tip) remains on the entry port 211 when the overpressure is applied; otherwise fluid might leak out of the entry port 211.

Instead of the diode valve 231, another type of mechanical valve may be present in the channel 230, e.g. a notch that generates a force and closes the channel 230 (not shown). Initially such a mechanical valve will be closed. After the inlet portion 210 has been filled, e.g. by an underpressure, the mechanical valve will be opened and the assay chamber 120 will be filled, e.g. due to a suction applied through the assay chamber, or due to capillary forces in the channel 230.

In still another embodiment, wetting of the assay chamber is hindered by a capillary stop, consisting e.g. of a hydrophobic material and/or meniscus-pinning geometries. When the inlet portion is filled with sample fluid, e.g. by suction applied through the assay chamber, the assay chamber is filled until the point where the fluid meniscus meets the hydrophobic stop. The assay is activated by pulling the meniscus across the capillary stop. This activation can be done by the application of an increased pressure on the inlet portion (e.g. by volume reduction) or by the application of an increased suction on the side of the assay chamber. The capillary stop needs to be able to withstand a pressure difference, e.g. the suction pressure applied during filling, or the hydrostatic pressure that occurs in the device due to gravity. Preferably the capillary stop has a small diameter or is a parallel arrangement of several small-diameter openings.

In still another embodiment, possibly used with the previous embodiment, the design of the cartridge 200 is such that, after sample uptake, the fluid meniscus is in the first section 201, beyond the connection unit 232, but without wetting the assay chamber 220 (the gas volume remaining in the assay chamber 220 and around until the fluid meniscus is then equivalent to the $V_{AC}$ of FIG. 2. In this way it is achieved that subsequent capillary transport (for filling-up the assay chamber 220 once for example the vent port 221 is open) does not include passage of the meniscus over the connection, which can be prone to failures.

In summary, an embodiment of a cartridge has been described, said cartridge having an inlet portion which is connected to an assay chamber and a suction reservoir. The inlet portion is designed for a direct uptake of sample medium, for example of blood from a patient. During this uptake, air is trapped in the assay chamber and typically also in the suction reservoir, which prevents a premature entrance of the medium into the assay chamber. The transfer of the medium to the assay chamber can thus controllably be initiated at a later time, for example by opening a vent port connected to the assay chamber.

The cartridges according to the described embodiments comprise a Sample Taking Unit (STU) and a Detection Assay Unit (DAU) with the following preferred features:

The STU contains four functional modules:

a sample entry port or inlet portion (with e.g. needles, foil, skin adhesive);

a sample or assay chamber;

a suction mechanism (e.g. preloaded vacuum, vacuum generation module);

an extraction port (e.g. septum, outlet to DAU).

The STU-DAU interface comprises:

a channel;

optional: a valving mechanism (e.g. capillary stop, permeable viscoelastic medium, releasable mechanical obstruction, gas entrapment in the DAU with vent piercing, diode valve).

The DAU contains:

a sample inlet port;

a channel;

a transport mechanism (e.g. capillary forces, gravity, preloaded vacuum, generated vacuum, mechanical volume displacement pump);

an assay chamber (e.g. magnetic nanoparticles, biosensing surface).

Optional functions that are distributed over the above components are:

a sample filtering;

a reagent storage and release;

a sample adequacy sensor/indicator.

An alternative embodiment of the cartridge 200 of FIG. 3 is the cartridge 200' of FIG. 3*bis* which is the same as the cartridge 200 of FIG. 3, except that the first part 201' contains the suction reservoir 240, further to the assay chamber 220 and a section of the channel 230', while the second part 202' does not contain any suction reservoir but still contains the inlet portion 210 and the remainder of the channel 230'. The first part 201 and the second part 202' can be coupled with for example a plug-and-socket type connection unit 232' in the middle of the channel 230', like in the embodiment of FIG. 3. Additionally, a second modification of the cartridge 200' may comprise a flow stop in the channel 230', for example realized as a diode or one-way valve 231', similarly to the cartridge 200 of FIG. 3. This flow stop 231' may be located on one or the other section of the channel 230'. The suction reservoir 240 can be located upstream of the assay chamber 220 (FIG. 3*bis*) of downstream of it (not shown).

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A cartridge for uptake and processing of a medium, comprising:

an inlet portion with an inlet via which the medium can be taken up;

an assay chamber in which the medium can be processed; and a suction reservoir;

wherein the assay chamber and the suction reservoir are connected to the inlet portion to trap a quantity of air in the assay chamber when the medium fills the inlet portion, and wherein the quantity of trapped air in the assay chamber stops the medium in the inlet portion from entering the assay chamber.

2. The cartridge according to claim 1, wherein the assay chamber and the inlet portion are connected by a capillary channel.

3. The cartridge according to claim 1, wherein the assay chamber is connected to a vent port that is closed during filling of the inlet portion with the medium.

4. The cartridge according to claim 1, wherein at least one of the assay chamber, the inlet portion and the suction reservoir is connected to a pressure actuator for controlling an internal pressure of the cartridge.

5. The cartridge according to claim 1, wherein a flow stop is disposed in a connection between the inlet portion and the assay chamber.

6. The cartridge according to claim 5, wherein the flow stop comprises one of a valve that can externally be controlled, a pressure controlled valve, and a medium repelling surface coating.

7. The cartridge according to claim 1, wherein the inlet portion comprises a sample extraction element.

8. The cartridge according to claim 1, wherein the inlet portion is, before use, closed to the environment.

9. The cartridge according to claim 1, wherein there is an underpressure in at least one of the inlet portion, the assay chamber, and the suction reservoir before the uptake of the medium into the inlet portion.

10. The cartridge according to claim 1, wherein a flow stop is disposed in the suction reservoir.

11. The cartridge according to claim 1, wherein the assay chamber and the inlet portion are disposed in different parts that can be coupled to each other.

12. A method for uptake and processing of a medium in a cartridge with an assay chamber and a suction reservoir connected to an inlet portion, said method comprising acts of:

uptaking of the medium into the inlet portion of the cartridge until the medium is stopped from entering the assay chamber by a counter pressure built up in air that is trapped in the assay chamber and the suction reservoir; and passing the medium on to the assay chamber by changing pressure in at least one of the assay chamber and the inlet portion.

13. The cartridge according to claim 6, wherein the pressure controlled valve is a diode valve.

14. The cartridge according to claim 7, the sample extraction element is one of a needle and a needle array.

15. The cartridge according to claim 3, wherein the vent port is opened for exit of the quantity air, trapped in the assay chamber, from the vent port and entry of the medium into the assay chamber from the inlet portion.

* * * * *